US007458671B2

(12) United States Patent
Leighton et al.

(10) Patent No.: US 7,458,671 B2
(45) Date of Patent: Dec. 2, 2008

(54) INK PRINTER HAVING IMPROVED RELEASE AGENT APPLICATION CONTROL

(75) Inventors: Roger G. Leighton, Rochester, NY (US); Gautam Dhar, Melbourne (AU); Paul John McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 490 days.

(21) Appl. No.: 11/313,316

(22) Filed: Dec. 21, 2005

(65) Prior Publication Data

US 2007/0139496 A1 Jun. 21, 2007

(51) Int. Cl.
*B41J 2/01* (2006.01)

(52) U.S. Cl. ..... 347/101; 347/103

(58) Field of Classification Search ..... 347/88, 347/95, 99, 101, 102, 103, 104; 399/237, 399/167, 66

See application file for complete search history.

(56) References Cited

U.S. PATENT DOCUMENTS 5,325,155 A * 6/1994 Perry ..... 399/167
5,734,402 A 3/1998 Rousseau et al.
5,808,645 A * 9/1998 Reeves et al. ..... 347/103
5,861,903 A 1/1999 Crawford et al.
5,988,808 A * 11/1999 Jones ..... 347/103
6,115,573 A * 9/2000 Izumi et al. ..... 399/237
7,036,920 B2 * 5/2006 Rousseau et al. ..... 347/103
7,065,308 B2 * 6/2006 Calamita et al. ..... 399/66

* cited by examiner

*Primary Examiner*—Stephen D Meier
*Assistant Examiner*—Rene Garcia, Jr.
(74) *Attorney, Agent, or Firm*—Maginot, Moore & Beck LLP

(57) ABSTRACT

A process controls application of a release agent to an intermediate imaging member in a printer rotating the intermediate imaging member in a single direction to generate and transfer an image. The process includes moving a release agent applicator into engagement with a rotating imaging member to apply release agent to the rotating imaging member, and subsequently engaging the rotating imaging member with a wiper blade so the wiper blade encounters a the applied release agent bar before the applied release agent reaches a transferring roller. The process further involves the disengagement of release agent applicator with variable time dwell and delayed disengagement of release agent wiper blade to reduce release agent bar. The engagement and disengagement of the release agent applicator and the release agent wiper blade are coordinated by two cams to reduce the likelihood that release agent is transferred to a transferring roller in a quantity sufficient to degrade image quality during duplex printing.

20 Claims, 9 Drawing Sheets

INK PRINTER HAVING IMPROVED RELEASE AGENT APPLICATION CONTROL

CROSS-REFERENCE

This disclosure cross-references co-pending U.S. Patent Application having Ser. No. 11/273,373 that is entitled Ink Printer Using Forward Direction Printing Process filed on Nov. 14, 2005, the disclosure of which is hereby expressly incorporated in its entirety by reference.

TECHNICAL FIELD

This disclosure relates generally to printers having an intermediate imaging member and, more particularly, to the components and methods for imaging in ink printers having an intermediate imaging member.

BACKGROUND

Solid ink or phase change ink printers conventionally receive ink in a solid form, either as pellets or as ink sticks. The solid ink pellets or ink sticks are placed in a feed chute and a feed mechanism delivers the solid ink to a heater assembly. Solid ink sticks are either gravity fed or urged by a spring through the feed chute toward a heater plate in the heater assembly. The heater plate melts the solid ink impinging on the plate into a liquid that is delivered to a print head for jetting onto a recording medium. U.S. Pat. No. 5,734,402 for a Solid Ink Feed System, issued Mar. 31, 1998 to Rousseau et al. and U.S. Pat. No. 5,861,903 for an Ink Feed System, issued Jan. 19, 1999 to Crawford et al. describe exemplary systems for delivering solid ink sticks into a phase change ink printer.

In known printing systems having an intermediate imaging member, such as ink printing systems, the print process includes an imaging phase, a transfer phase, and an overhead phase. In ink printing systems, the imaging phase is the portion of the print process in which the ink is expelled through the piezoelectric elements comprising the print head in an image pattern onto the image drum or other intermediate imaging member. The transfer or transfix phase is the portion of the print process in which the ink image on the image drum is transferred to the recording medium. The overhead phase is the portion of the print process in which the operation of the intermediate imaging member and the transfer roller are synchronized for transfer of the image from the image drum or intermediate imaging member.

In currently known print processes for ink printing machines, bi-directional rotation of the intermediate imaging member is used for formation of the image on the intermediate imaging member. After the image is formed, the intermediate imaging member is stopped and its direction of rotation is reversed for transfer of the image from the drum. As the leading edge of the image approaches the transfer roller, the transfer roller is engaged to press the recording medium against the intermediate imaging member for transfer of the image from the intermediate imaging member to the recording medium. The intermediate imaging member is rotated more slowly during the transfer phase to transfer the image to the recording medium more efficiently. After the image is transferred and while the recording medium which bears the image is being transported into the output tray, the transfer roller is disengaged and the intermediate imaging member rotation is reversed for a new imaging operation.

In an improvement for such a printer, the intermediate imaging member is rotated in the same direction for both generating an image on the imaging member and transferring the generated image to a sheet of media. Such a printer is described in co-pending patent application Ser. No. 11/xxx, xxx entitled "Ink Printer Using Forward Direction Printing Process" that was filed on Nov. 14, 2005 and is commonly owned by the-assignee of this application. In this type of printer, the intermediate imaging member is slowed and the sheet of media is registered with the transferring roller as the image rotates into position for the transfer. Timing the registration of the media sheet with the generated image on the imaging member is complicated by the delivery of release agent layer on the imaging member with known drum maintenance systems. The release agent layer is applied by a drum maintenance roller that also moves into and out of engagement with the imaging member. If the transferring roller engages the imaging member before the media sheet reaches the nip between the imaging member and the transferring roller, then release agent is transferred to the transferring roller. This release agent may then be transferred to the back side of the media sheet as an image is transferred from the imaging member to the front side of the media sheet.

The presence of release agent on the transferring roller typically does not affect printing for one-sided images as the release agent is only on the side of the media sheet to which no image was transferred. In duplex or two-sided printing, the presence of release agent may degrade the quality of the image. This degrading occurs because the release agent on the back side of the media sheet affects the transfer of ink from the imaging member to the media sheet. Consequently, the coordination of the arrival of the image on the imaging member and the registration of the media sheet at the transferring roller is important for good image transfer, particularly in duplex printing operations.

Another issue arising from the use of known drum maintenance systems is the occurrence of streaks at the beginning of a transferred image. These streaks may be caused by too little release agent being delivered to the imaging agent near the leading edge of area on the imaging member in which the image is generated. These streaks typically occur near the end of life of the drum maintenance roller. Additionally, near the end of the drum maintenance roller life, the volume of release agent applied to the imaging member may be low as the drum is disengaged from the imaging member. Thus, a drier zone may occur near the end of the area in which an image is generated and streaks may result.

SUMMARY

In order to better coordinate image and media sheet presentation at a transferring roller in a single direction printer, a new transfer and release agent process and apparatus have been developed. The process and apparatus coordinate the engagement/disengagement of the drum maintenance roller and wiper blade with the imaging member in a manner that improves the supply of release agent at the end of the drum maintenance roller life and reduces release agent bar volume on the imaging member.

A process for applying release agent to an imaging member includes moving a release agent applicator into engagement with a rotating imaging member to apply release agent to the rotating imaging member. and subsequently engaging the rotating imaging member with a wiper blade so the wiper blade encounters a release agent bar formed by the applied release agent before the release agent bar reaches a transferring roller nip. This synchronization of the wiper blade and release agent application with the imaging member enables a fluid front formed by the release agent applied to the imaging member to provide adequate coverage to reduce the likelihood of dry areas on the imaging member while also enabling the wiper blade to remove excess release agent so release agent is not transferred to the transferring roller during the transfer operation.

A release agent apparatus for use in a solid ink jet printer includes an intermediate imaging member onto which an image may be generated, a print head for ejecting ink onto the intermediate imaging member to form an image on the intermediate imaging member as it rotates in a first direction, a drum maintenance roller for engaging the intermediate imaging member to apply release agent after the intermediate imaging member has slowed its rotation for transfer of an image on the image member to a sheet of recording media, and a release agent wiper blade for engaging the intermediate imaging member after the drum maintenance roller has engaged the intermediate imaging member to remove a portion of the release agent applied to the intermediate imaging member by the drum maintenance roller so the level of release agent on the intermediate imaging member preserves duplex printing on the sheet of recording media.

BRIEF DESCRIPTION OF THE DRAWINGS

The foregoing aspects and other features of an ink printer implementing a forward direction printing process are explained in the following description, taken in connection with the accompanying drawings, wherein.

DETAILED DESCRIPTION

Figure 1:
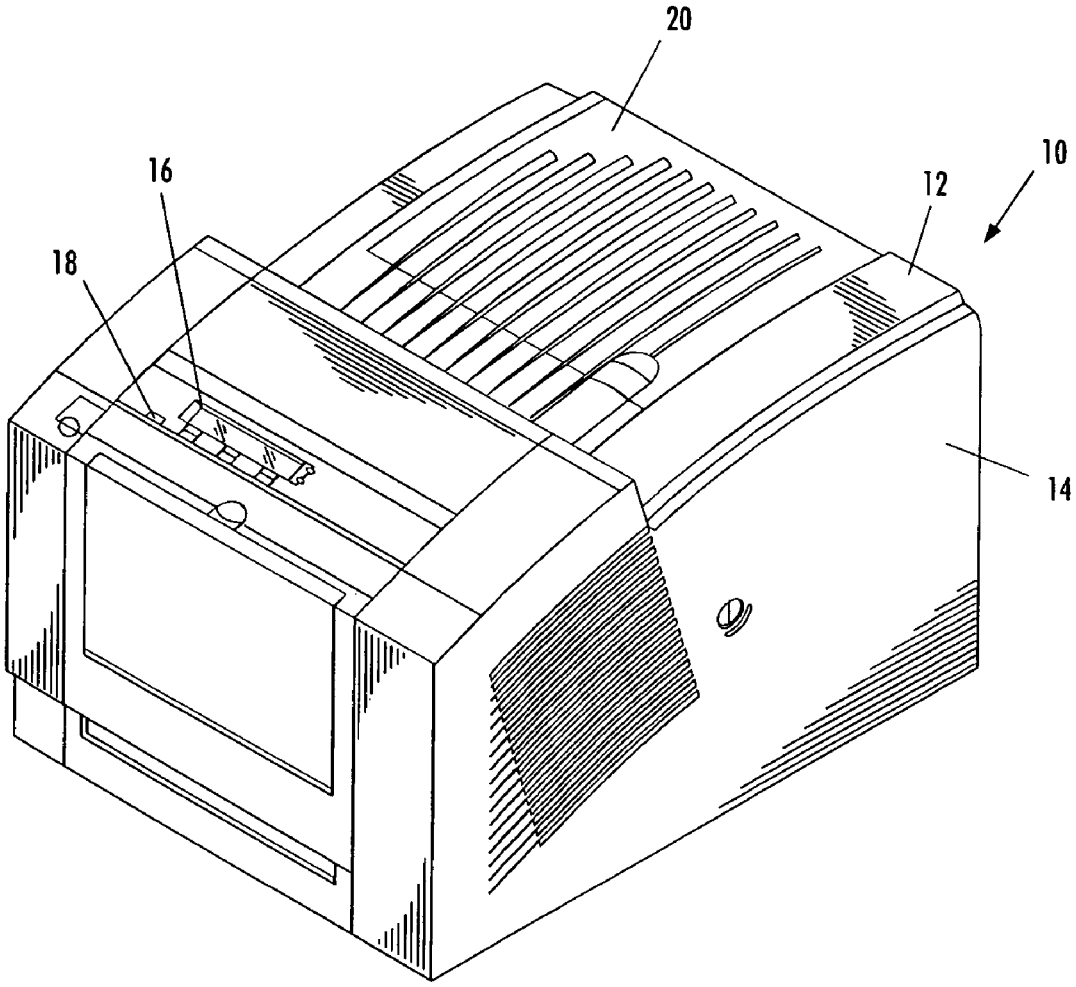
FIG. 1 is a perspective view of an ink printer with the printer top cover closed.

Referring to FIG. 1, there is shown a perspective view of an ink printer 10 that implements a single direction print process that preserves duplex printing capability. The reader should understand that the embodiment discussed herein may be implemented in many alternate forms and variations. In addition, any suitable size, shape or type of elements or materials may be used.

FIG. 1 shows an ink printer 10 that includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 20 that opens as shown in FIG. 2, to provide the user access to the ink feed system.

Figure 2:
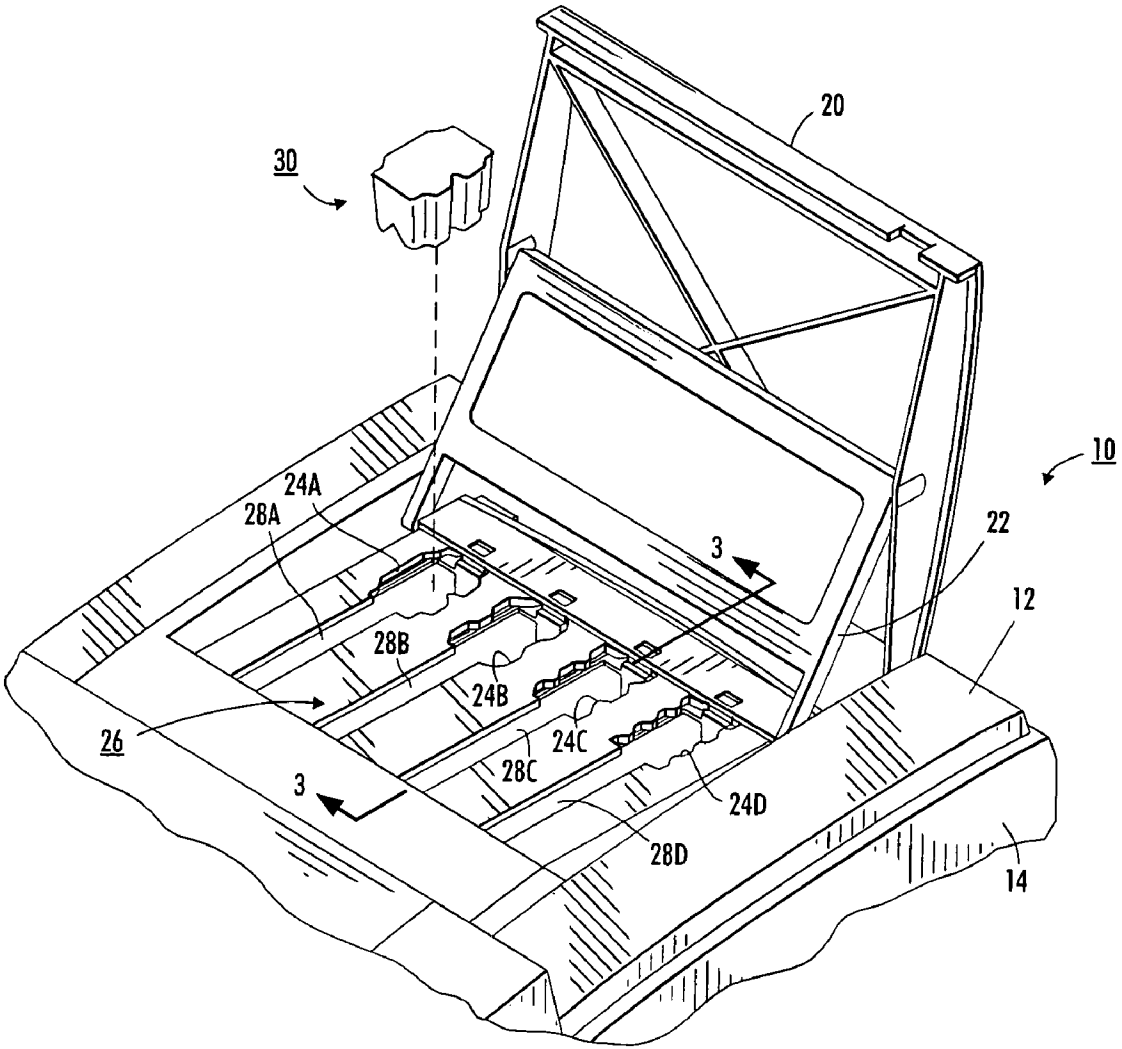
FIG. 2 is an enlarged partial top perspective view of the ink printer with the ink access cover open, showing a solid ink stick in position to be loaded into a feed channel.

In the particular printer shown in FIG. 2, the ink access cover 20 is attached to an ink load linkage element 22 so that when the printer ink access cover 20 is raised, the ink load linkage 22 slides and pivots to an ink load position. The ink access cover and the ink load linkage element may operate as described in U.S. Pat. No. 5,861,903 for an Ink Feed System, issued Jan. 19, 1999 to Crawford et al. As seen in FIG. 2, opening the ink access cover reveals a key plate 26 having keyed openings 24A-D. Each keyed opening 24A, 24B, 240, 24D provides access to an insertion end of one of several individual feed channels 28A, 28B, 28C, 28D of the solid ink feed system.

A color printer typically uses four colors of ink (yellow, cyan, magenta, and black). Ink sticks 30 of each color are delivered through a corresponding individual one of the feed channels 28A-D. The operator of the printer exercises care to avoid inserting ink sticks of one color into a feed channel for a different color. Ink sticks may be so saturated with color dye that it may be difficult for a printer user to tell by color alone which color is which. Cyan, magenta, and black ink sticks in particular can be difficult to distinguish visually based on color appearance. The key plate 26 has keyed openings 24A, 24B, 240, 24D to aid the printer user in ensuring that only ink sticks of the proper color are inserted into each feed channel. Each keyed opening 24A, 24B, 240, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 3:
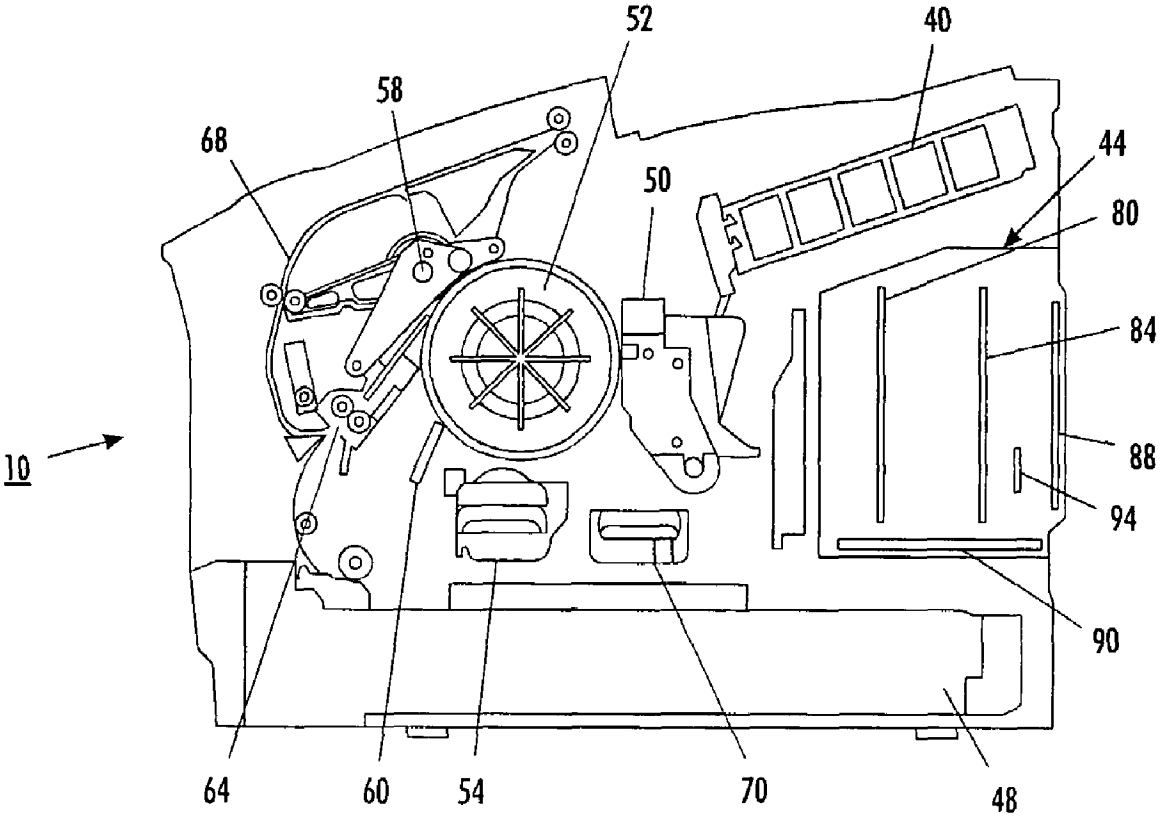
FIG. 3 is a side view of the ink printer shown in FIG. 2 depicting the major subsystems of the ink printer.
Figure 4:
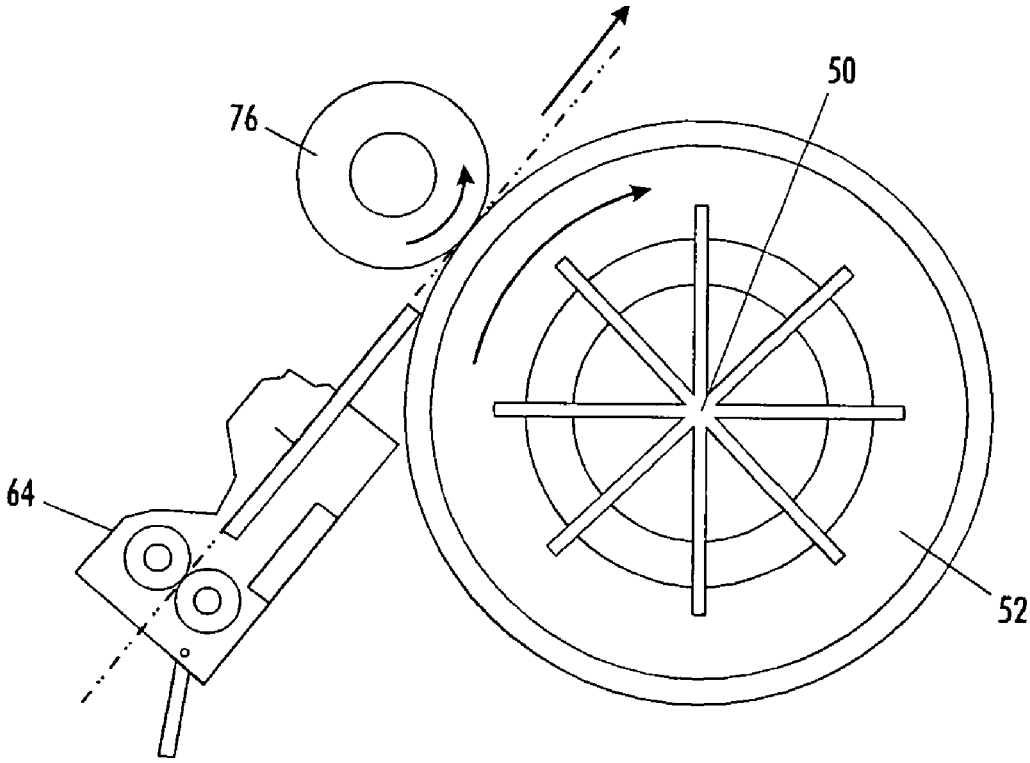
FIG. 4 is a side view of the relationship between the transfer roller and the intermediate imaging member.

As shown in FIG. 3, the ink printer 10 may include an ink loading subsystem 40, an electronics module 44, a paper/media tray 48, a print head 50, an intermediate imaging member 52, a drum maintenance subsystem 54, a transfer subsystem 58, a wiper subassembly 60, a paper/media preheater 64, a duplex print path 68, and an ink waste tray 70. In brief, solid ink sticks 30 are loaded into ink loader 40 through which they travel to a melt plate (not shown). At the melt plate, the ink stick is melted and the liquid ink is diverted to a reservoir in the print head 50. The ink is ejected by piezoelectric elements through apertures in chemically etched stainless plates to form an image on the intermediate imaging member 52 as the member rotates. An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfer roller in the transfer subsystem 58 and the intermediate image member 52 is coordinated for the transfer of the image from the imaging member to the sheet of recording media. The presentation of a recording media sheet between a transfer roller 76 and the intermediate imaging member 52 is shown in more detail in FIG. 4.

A duplex image includes a first image that is transferred from the intermediate imaging member onto a first side of a recording media sheet followed by a second image that is transferred from the intermediate imaging member onto the reverse side of the recording media sheet to which the first image was transferred. One problem that occurs in printing systems that apply a release agent to the intermediate imaging member is the contamination of the reverse side of a recording media sheet with release agent during the transfer of the first image onto the sheet. This contamination may then generate defects during the transfer of the second image on the reverse side of the recording media sheet. If a duplex image is to be transferred to the reverse side of a sheet, the reverse side of the sheet is presented to the intermediate imaging member by directing the sheet through the duplex print path 68 after it has passed through the transfer roller for the transfer of the first image. As the transfer process is repeated, the second image is transferred from the intermediate imaging member 52 to the reverse side of the sheet imaged during the previous transfer cycle. The sheet bearing the duplex image is then ejected by the ejection rollers 74 and deposited in the output tray 78.

The operations of the ink printer 10 are controlled by the electronics module 44. The electronics module 44 includes a power supply 80, a main board 84 with a controller, memory, and interface components (not shown), a hard drive 88, a power control board 90, and a configuration card 94. The power supply 80 generates various power levels for the various components and subsystems of the ink printer 10. The power control board 90 regulates these power levels. The configuration card contains data in nonvolatile memory that defines the various operating parameters and configurations for the components and subsystems of the ink printer 10. The hard drive stores data used for operating the ink printer and software modules that may be loaded and executed in the memory on the main card 84. The main board 84 includes the controller that operates the ink printer 10 in accordance with the operating program executing in the memory of the main board 84. The controller receives signals from the various components and subsystems of the ink printer 10 through interface components on the main board 84. The controller also generates control signals that are delivered to the components and subsystems through the interface components. These control signals, for example, drive the piezoelectric elements to expel ink through the apertures in the chemically etched print plates to form the image on the imaging member 52 as the member rotates past the print head.

In previously known solid ink printers, the more efficient print process imaged the member 52 as it rotated in a first direction, stopped the member rotation, reversed the member rotation, and then transferred the image from the intermediate imaging member onto the sheet of recording media. This process enabled the transfer roller 76 to be moved to form the nip for transferring the image to the media sheet as the edge of the paper was coming to the nip. This reduced the likelihood that the transfer roller 76 contacted intermediate member 52 and became contaminated with release agent. The directional control of the member rotation was performed by the controller of the main board 84 in accordance with signals generated by the controller. In an effort to obtain greater throughput rates, efforts have been made to perform the imaging and transferring phases as the intermediate member rotated in the same direction to reduce the amount of overhead associated with stopping and reversing the intermediate member 52. These efforts, however, have resulted in the transfer roller 76 contacting the intermediate roller 52 before the edge of the media sheet arrives at the nip between the roller 76 and the imaging member 52. Consequently, release agent is transferred to the transferring roller 76 and this release agent is transferred from the roller 76 to the reverse side of recording media sheets. The release agent may be present on the reverse side of media sheets at levels that degrade the quality of duplex images on the sheet.

In an improved print process, the controller rotates the intermediate imaging member 52 in the same direction for imaging and transferring, but the imaging member is rotated at a faster speed during the imaging phase than it is for the transferring phase. Additionally, the drum maintenance subsystem 54 and the wiper subassembly 60 are operated in a way that reduces the likelihood of release agent contamination of the reverse side of a recording media sheet as it passes between the transfer roller 76 and the intermediate imaging member 52.

Figure 5:
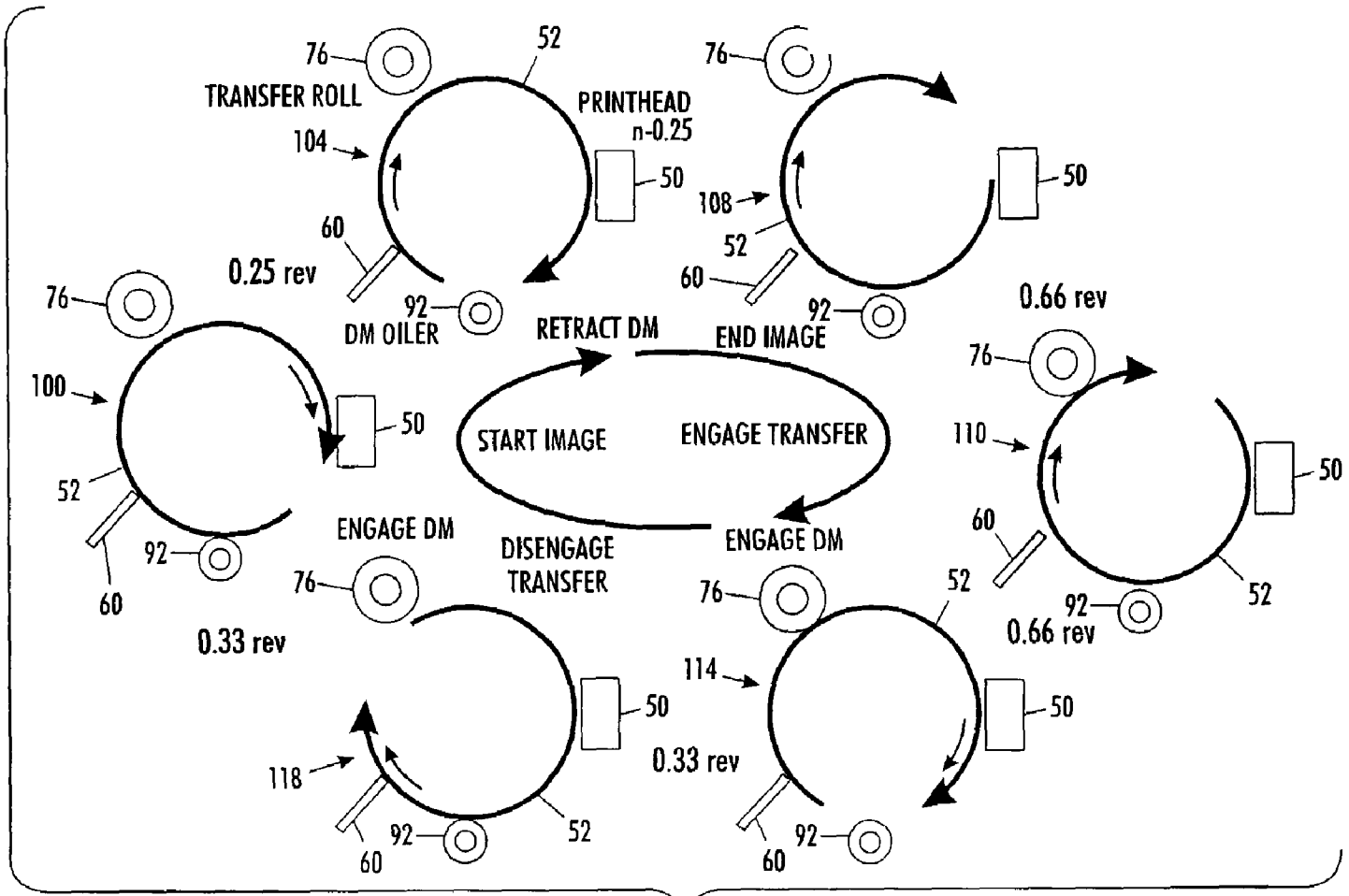
FIG. 5 is an overview of the relationships between the intermediate imaging member, the transfer subsystem, and the drum maintenance system during the forward imaging process.

The single direction imaging print process is shown in FIG. 5. In the figure, the intermediate imaging member rotates in the direction indicated by the arrow. At the beginning (100) of the imaging phase, the start of the imaging area of the intermediate imaging member 52 is presented to the print head 50 for generation of the image on the intermediate imaging member 52. The transfer roller 76 is not in engagement with the imaging member 52 at this time. The drum maintenance roller 92 is in contact with a different portion of the intermediate imaging member 52 to apply release oil to the intermediate imaging member. The release oil applied by the drum maintenance roller 92 is internally stored within the drum maintenance roller. Pressure exerted by engaging the drum maintenance roller into contact with the intermediate imaging member 52 delivers release agent from the drum maintenance roll to the intermediate imaging member 52. The wiper subassembly 60 meters the application of the release agent as the release agent blade in the wiper subassembly is engaged to contact the intermediate imaging member and remove release agent applied by the drum maintenance roller.

Approximately a quarter of a revolution after the imaging phase commences (104), the imaging phase of the print process continues as the drum maintenance roller 92 is disengaged so it no longer contacts the intermediate imaging member. If the imaging phase shown in FIG. 5 is the first of a sequence of images to be formed on the intermediate member 52, the drum maintenance roller is controlled to engage the intermediate member 52 prior to the start of the imaging phase. This operation enables the intermediate member 52 at least an entire revolution of the intermediate member to be treated with release agent. The print head 50 continues to eject ink onto the imaging member 52 under the control of the controller to generate an image on the member 52. The imaging phase of the single direction print process ends (108) as the last portion of the imaging area of the imaging member 52 is imaged while the transfer roller and the drum maintenance roller remain disengaged. The imaging shown in FIG. 5 may represent an imaging phase that occurs over multiple revolutions of the intermediate member.

As the beginning of the imaging area approaches the transfer subsystem on the next revolution following the one in which the image on the imaging member was generated (110), the transfer roller is engaged to contact and form a nip with the imaging member so a sheet of recording media is pressed between the transfer roller and the imaging member. In one embodiment, the transfer roller is sized so that about 3 mm of the imaging member's circumference is pressed within the nip at the transfer roller. As the image is transferred onto the sheet, the controller regulates the surface speed of the transfer roller, the intermediate imaging member, and the sheet of recording media to be substantially equal. In one embodiment, the speed of the imaging member 52 is reduced as it approaches the transfer roller for the transferring of the image onto the sheet of the recording media. In one embodiment, the transfer roller, imaging member, and sheet are maintained at a speed in the range of approximately 15 to approximately 35 inches per second for transferring the image onto the first side of a sheet, and, if an image is transferred on the reverse side, the speed is regulated to be in the range of approximately 5 to approximately 20 inches per second. In order to maintain these speeds, the transfer roller is urged against the intermediate imaging member with known components at pressures of 500 to 800 psi in the nip region. The transfer roller in one embodiment has a relatively hard inner elastomer layer and a relatively soft outer elastomer layer. Such a roller, for example, has an inner elastomer layer that is approximately 2.2 mm thick with a 64 ShoreD durometer value and an outer elastomer layer that is 0.3 mm thick with a 70 ShoreA durometer value. The transfer roller may, however, have only a single elastomer layer or have more than two elastomer layers.

In this embodiment, an increase in printer productivity is facilitated by interleaving the image transfer and drum maintenance engage and disengage functions. As the trailing end of the media sheet approaches the transfer roller, the drum maintenance roller and wiper blade engage the intermediate member to being applying a layer of release agent for the next sheet. The transfer roller then disengages the intermediate member as the end of the sheet exits the nip at the transfer roller. The drum maintenance roller then continues to apply release agent until an area of the intermediate member that corresponds with the area of a media sheet has release agent applied to it. The drum maintenance roller and the wiper blade disengage from the intermediate member while an image is being formed on the intermediate member. The interleaved motions reduce inefficiencies in the overhead phase of the printing process.

To facilitate separation of the sheet of recording media from the transfer roller after the image is transferred onto the sheet, known components may be provided in the transferring subsystem. These components may include an air knife, stripper fingers, or a stripper blade. In one embodiment, a plastic stripper blade may be actuated so it contacts only the substrate at the lead edge as it leaves the transfer roller nip to facilitate separation.

Additional parameters that may be controlled by an ink printer implementing a single direction print process are the temperatures of the recording media sheets and the imaging member. The imaging member may be heated by placing a heater either in the internal volume of the imaging member or proximate the exterior of the member and monitoring the surface temperature with a sensor placed in proximity to the member. Such heaters are well known and include halogen heaters or inductive heaters. The transfer subsystem may also include a heater for heating the recording media sheets. Such a heater may be a clamshell plate-on-plate heater that is closed for transferring images on a single side of a sheet and opened for the reverse side of sheet subjected to duplex transferring. In one embodiment, the recording media sheet heater is maintained at 65° C. and the imaging member heater is regulated so the temperature of the member remains in the range of approximately 40° C. to approximately 70° C. These temperatures are used as they tend to keep the image ink at a phase that is not so hard that the ink does not adequately adhere to the sheet and not so liquid that the ink shears and leaves a residual layer on the imaging member. Of course, the chemical composition of the ink may alter the optimal temperature or temperature range for the image ink and paper.

After the beginning of the imaging area on the imaging member has passed through the transferring nip and past the print head (114, FIG. 5), a drum maintenance roller may be engaged to contact the intermediate imaging member. The drum maintenance roller contains a release agent that is dispensed from the drum agent by the pressure exerted between the drum roller and the intermediate imaging member. Release agent on the surface of the imaging member is thought to reduce adhesion between the ink and the imaging member so transfer speed may be increased and pressure in the transfer nip may be reduced. An effective application of release agent is approximately 25-1000 nanometers in thickness.

Effective release agents include silicone fluids comprised of a blend of an organo-functional silicone oil and a non-functional silicone diluent. The concentrated organo-functional portion reacts with the imaging drum surface coating to improve oil uniformity while the diluent helps determine the overall release agent viscosity. In one embodiment, an amine functional silicone fluid is ued that is comprised of approximately 0.025-0.15 mol % amine and a viscosity of 10-100 cP. In some applications, lower amine levels, such as, 0.025-0.075 mol % amine, and viscosities of 10-30 cP may enhance transferring performance. In one embodiment, a release agent viscosity that is less than 70 cP is used to minimize oil bar size on the intermediate imaging member as discussed in more detail below.

As the end of the imaging area on the imaging member exits the transfer subsystem (118, FIG. 5), the transfer roller is disengaged and removed from being in contact with the imaging member. During this phase, the drum maintenance roller and wiper subassembly continue to apply and meter release agent to the intermediate imaging member. As the beginning of the imaging area approaches the print head 50, the single direction print process begins another cycle.

Figure 6:
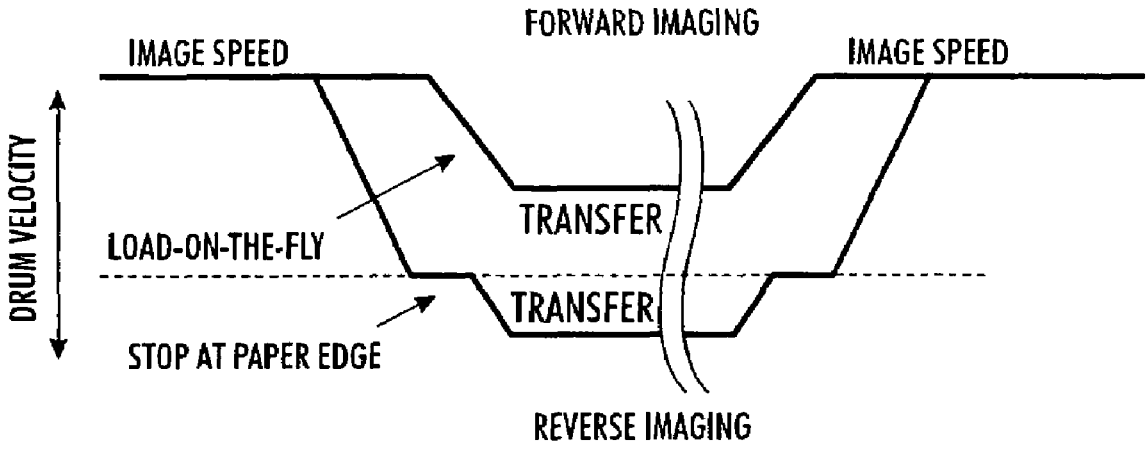
FIG. 6 is a graphical comparison of the intermediate imaging member speed in a forward imaging process and in a reverse imaging process.

As shown in FIG. 6, the single direction print process depicted in FIG. 5 enables the imaging member to rotate at a higher speed than is effective when the reverse direction process is implemented. As shown in FIG. 6, the imaging member is at an imaging speed as an image is generated on the imaging member. In the reverse process, the imaging member is stopped (indicated by the dotted line). The imaging member is then rotated in a reverse direction until it reaches the transferring speed in the reverse direction. As the beginning of the image area approaches the transfer roller, the transfer roller is engaged to contact the imaging member. The controller compensates for any drop in the speed of the imaging member so the member continues to rotate at the transferring speed during the transferring phase. Once the image has been transferred to the recording media sheet, the imaging member is slowed and then stopped. The direction of the imaging member is then reversed and the imaging member speed is ramped up to the imaging speed again. By contrast, the single direction process does not bring the imaging member rotation to a stop, but rather slows the member to a transferring rotational speed that is in the same direction as the imaging phase rotation. After the image has been transferred, the imaging member rotational speed is increased to the imaging speed.

As may be observed from FIG. 6, the imaging member returns to the imaging speed more quickly in the single direction print process than it does in the bi-directional print process. One benefit in the overall reduction in time for an imaging/transferring cycle is increased throughput. Additionally, the motor does not need to generate as great a torque in the single direction print process as it does in the bi-directional print process because it does not need to accelerate the intermediate member while the transfer roll and its associated torque are engaged. In one embodiment, the kinetic energy stored in the rotating drum during the transfer phase helps to urge the media through the nip between the transfer roller and the intermediate member. The dynamic registration of the media with respect to the image on the intermediate member may be denoted as 'on the fly' registration. Thus, an ink printer that only implements the single direction print process may use a smaller motor than an ink printer that implements the bi-directional print process.

Another benefit of the single direction print process is that the imaging member drum speed is greater at drum maintenance roller disengagement. The higher speed is made possible by the disengaging of the maintenance roller from the imaging member after the member has reached the imaging speed. The higher speed of the member when the maintenance roller is released reduces the size of the oil bar at end of the imaging area on the imaging member. In one embodiment, the drum maintenance roller disengages from the intermediate member while the intermediate member is rotating at a surface speed of approximately 50 inches per second or greater (ips). The oil bar is the line of demarcation of release agent that is left on the imaging member as the wiper blade 60 disengages from the intermediate member. The excessive oil in the oil bar may the source of multiple machine difficulties. For example, excess oil in an oil bar may be splattered into machine components, such as the face of the print head. The level of the oil in the oil bar may be great enough that it is transferred to the transfer roller and then one revolution of the transfer roll later transferred to the reverse side of a sheet to which an image is being transferred. If this sheet is subjected to the duplex printing process, the oil on the sheet may be sufficient enough to degrade the image on the second side printed on the sheet. Therefore, a reduction in the oil bar size reduces the likelihood that the oil bar affects the quality of an image transferred to the reverse side of a recording media sheet.

Excessive oil on the reverse side of a recording media sheet may also be reduced by controlling the distance between the disengaging of the maintenance roller and the disengaging of a release agent wiper blade. The release agent wiper blade is typically a pivoting member that reaches across the width of the imaging member. In order to be effective, the imaging member is rotating in a direction so that the surface of the member contacts the maintenance roller before encountering the wiper blade. After the maintenance drum contacts the imaging member and begins to apply release agent oil to the imaging member, the wiper blade is pivoted so its outboard edge contacts the member and removes excess oil from the surface of the member. In one embodiment, the wiper blade is pivoted so it no longer contacts the imaging member after at least 50 mm of the imaging member surface has rotated past the position where the drum maintenance roller disengaged from the member. The delay in pivoting the wiper blade away from the imaging member reduces the oil bar on the imaging member by reducing the volume of oil that is dammed behind the blade. In one embodiment, the size of the oil bar is reduced by positioning the wiper blade so that the angle at the blade tip at the line touching the imaging member is greater than 60° and the blade holder angle at the last touch of the blade to the member is greater than 80°.

Figure 7:
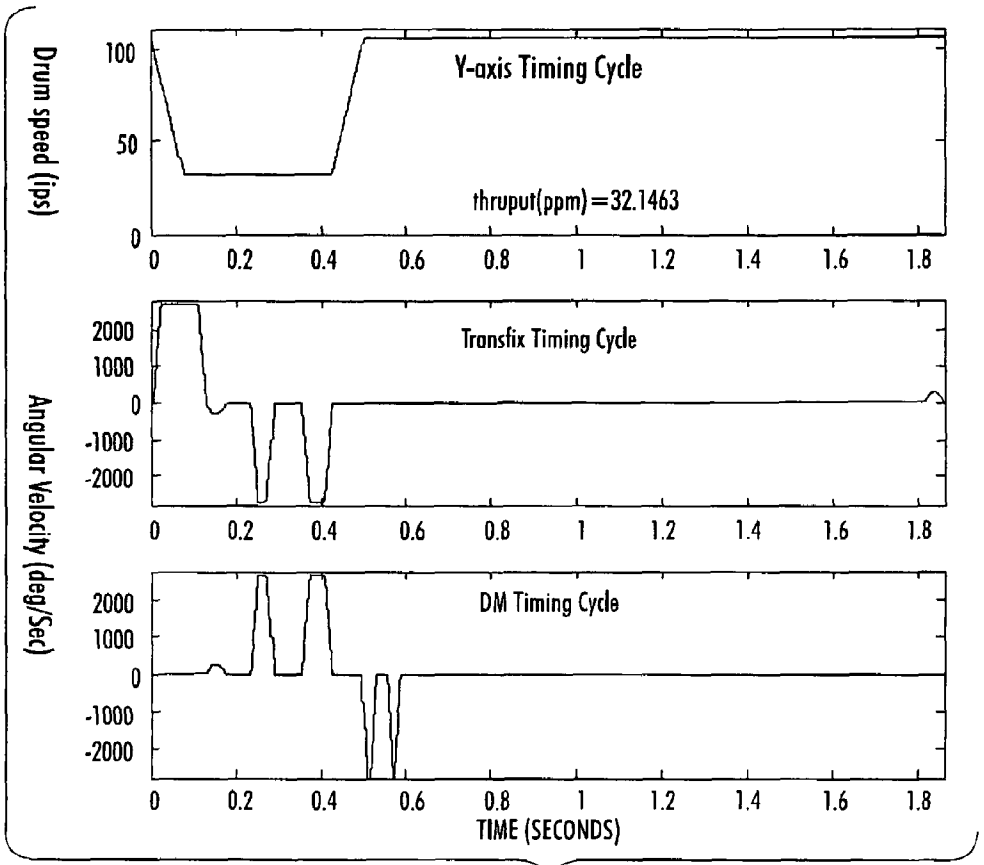
FIG. 7 is a graphical comparison of the timing relationships between the speed of an intermediate imaging member, drum maintenance roller, and the transfer roller in one embodiment.

A comparison of the rotational speed of the intermediate imaging member, transfer roller, and drum maintenance roller in one embodiment is shown in FIG. 7. The top graph depicts the imaging speed of the intermediate member as it slows from an imaging speed of approximately 105 inches per second (ips) to the transfer speed of approximately 32 ips. After the transfer process has occurred, the intermediate member is returned to the imaging speed of 105 ips. The next graph depicts the angular velocity of the transfer roller in relation to the speed transitions in the intermediate member. The lowest graph depicts the angular velocity of the drum maintenance roller in relation to the speed transitions in the intermediate member speed as well as the engagement and disengagement of the drum maintenance roller and the release agent wiper blade with the intermediate imaging member. These exemplary relationships help provide maximum throughput in the machine depicted in FIG. 3, although other timing relationships may be more optimal with other machine configurations and parameters. The timing relationships in depicted in FIG. 7 help minimize the maximum slew and acceleration rates for the motor driving the transfer roller. These timing relationships also enable known motor gearboxes to be used without unduly stressing the motor with high temperature.

In one embodiment, the controller for the machine includes a monitor that accumulates the time during which the drum maintenance roller is in engagement with the intermediate imaging member. This accumulated time is stored and compared to thresholds by the controller to determine whether the dwell time used to regulate the duration of the drum maintenance roller and intermediate imaging member engagement should be adjusted. At the beginning of the life cycle for the drum maintenance roller, the dwell time is adjusted to a length that enables sufficient release agent to be applied to the intermediate imaging member without undue waste of the release agent. Later in the life cycle of the drum maintenance roller, the dwell time is increased to enable application of a sufficient amount of release agent to be applied to the intermediate imaging member without causing dry areas. Accordingly, the dwell time likely increases as the accumulated time for engagement of the drum maintenance roller and the intermediate imaging member increases.

Figure 8:
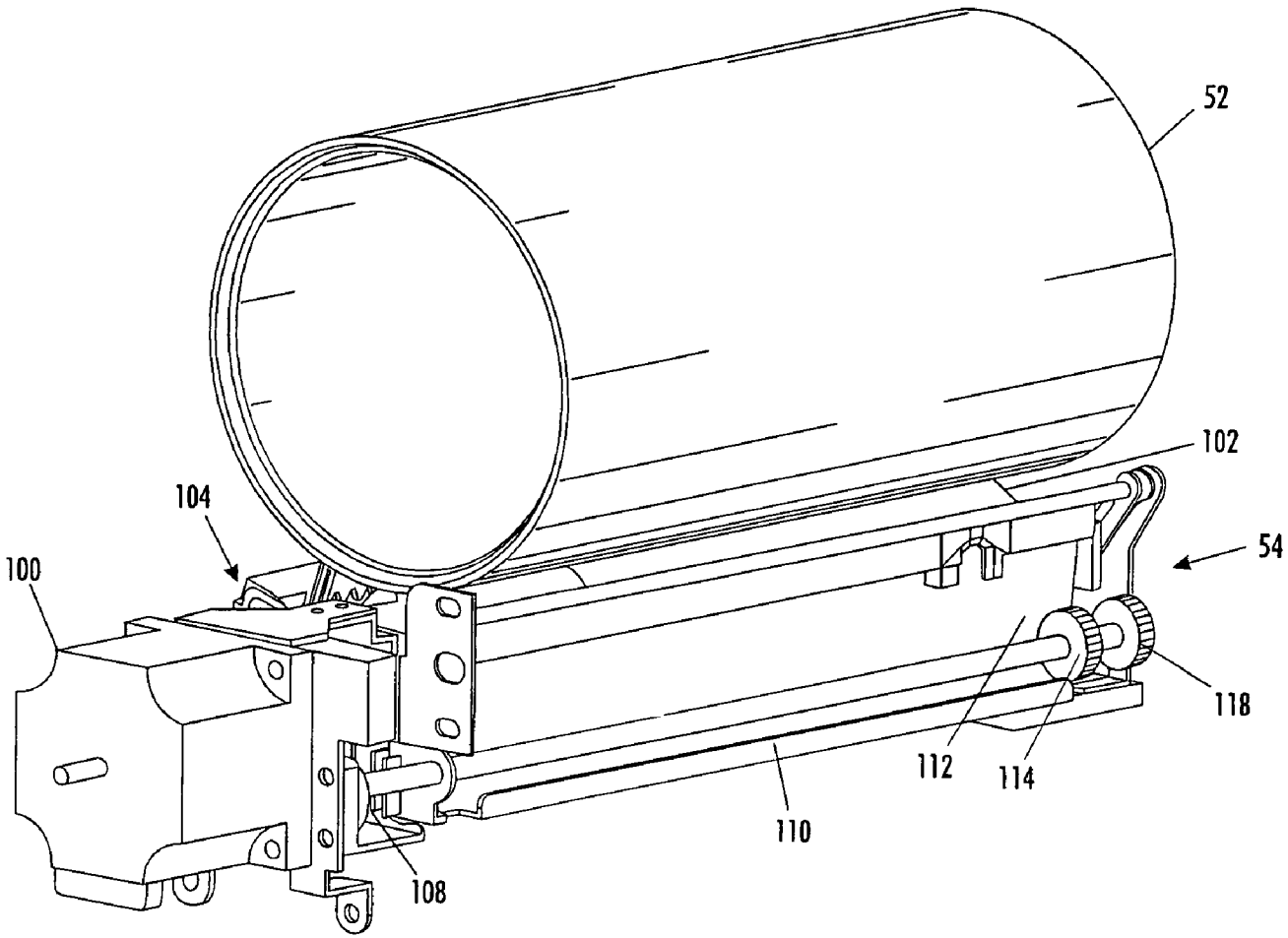
FIG. 8 is a perspective view of a drum maintenance roller apparatus that regulates the delivery of release agent to an intermediate imaging member over the life of the drum maintenance roller.

A drum maintenance apparatus that may be used in the machine shown in FIG. 3 is depicted in FIG. 8. The drum maintenance apparatus 54 includes a drum maintenance roller 102 that is housed within a drawer 104. The drum maintenance roller 102 is driven by a motor 100. A second motor 108 turns a shaft 110 to rotate a first cam 114 and a second cam 118. The first cam 114 operates as a drum maintenance roller coordinator to move the drum maintenance roller 102 into and out of engagement with the intermediate member 52. In one embodiment, the first cam achieves this movement by acting on a drawer follower 112. The second cam 118 operates as a release agent blade coordinator to move the release agent wiper blade 60 into and out of engagement with the intermediate imaging member 52. The second cam achieves this movement by operating on a wiper blade arm. Two cams are used to de-couple the movement of the drum maintenance roller from the movement of the release agent wiper blade.

A flat faced oscillating cam follower design may be used for both the wiper blade and drum maintenance roller motions. One set of equations that may be used to determine the follower motion as a function of the input cam motion includes:

$$\tan(\Theta) = \frac{\frac{+\partial\zeta}{\partial\phi}}{1 - \frac{\partial\zeta}{\partial\phi}} \frac{m\cos(\zeta)}{f - m\sin(\zeta)},$$

the kinematic equation, and $$\tan(\Theta) = \frac{\sqrt{R^2 - (f - m\sin(\zeta))^2}}{f - m\sin(\zeta)},$$

the geometric equation. These equations may be used to generate the differential equation $$\frac{\partial\phi}{\partial\zeta} = \frac{\sqrt{R^2 - (f - m\sin(\zeta))^2}}{\sqrt{R^2 - (f - m\sin(\zeta))^2 + m\cos(\zeta)}}.$$

Figure 9:
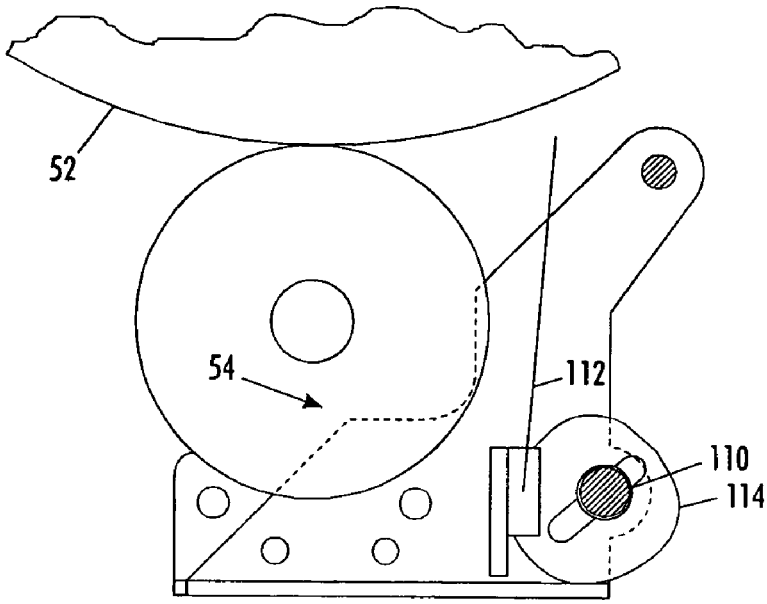
FIG. 9 is a perspective view of a drum maintenance roller coordinator used to move a drum maintenance roller into and out of engagement with an intermediate imaging member.

This differential equation may be evaluated using a mathematical computer program such as Matlab. The dimensions used in the equation are shown in FIG. 9.

Figure 10:
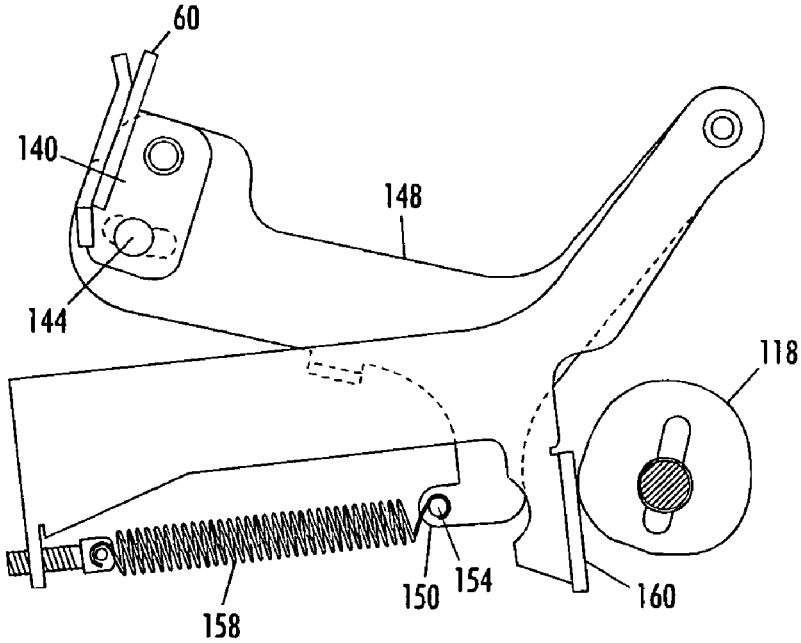
FIG. 10 is a perspective view of a release agent wiper blade coordinator used to move a release agent wiper blade into and out of engagement with an intermediate imaging member.

In one embodiment, the release agent wiper blade control structure is as shown in FIG. 10. The wiper blade 60 is secured by a holder 140. The angle of the blade may be adjusted by loosening the fastener 144 for the holder 140, moving the holder, and then tightening the fastener 144. A protrusion 150 on the wiper blade arm 148 is coupled by a fastener 154 to one end of a wiper blade spring 158. The other end of the spring 158 is coupled to the drum maintenance roller drawer. The wiper cam 118 acts on a wiper blade follower 160 and the backside of the follower 160 operates on a portion of protrusion 150 to move the wiper blade arm and wiper blade. The spring 158 biases the protrusion into the follower 160. The lobes of the cam 118 overcome this bias as the motor 108 rotates the cam 118 to move the wiper blade arm and wiper blade in the manner described above.

Those skilled in the art will recognize that numerous modifications can be made to the specific implementations described above. Those skilled in the art will recognize that the single direction print process and release agent control may be adapted for other printers using an intermediate imaging member, such as xerographic printers or offset lithographic printers. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. A process for applying release agent to an imaging member comprising:

slowing rotation of an intermediate imaging member having an ink image thereon to a transfer speed as the ink image approaches a transfer roller for transfer of the ink image to media passing through a nip formed between the transfer roller and the intermediate imaging member;

moving a release agent applicator into engagement with the rotating intermediate imaging member at the transfer speed to apply release agent to the rotating intermediate imaging member after a portion of the ink image has passed the transfer roller;

subsequently engaging the rotating imaging member at the transfer speed with a wiper blade to enable the wiper blade to meter a release agent bar formed by the applied release agent before the release agent bar reaches the transferring roller nip; and continuing engagement of the release agent applicator and the wiper blade with the intermediate imaging member at the transfer speed to apply and to meter the release agent on the intermediate imaging member as the ink image is transferred to the media in the nip.

2. The process of claim 1 further comprising:

disengaging the transfer roller from the intermediate imaging member after the ink image has been transferred to the media;

increasing a speed of rotation of the intermediate imaging member from the transfer speed after disengagement of the transfer roller, but before moving the release agent applicator out of engagement with the rotating intermediate imaging member.

3. The process of claim 1 further comprising:

disengaging the release agent applicator from the rotating intermediate imaging member as a printhead is ejecting ink onto the intermediate imaging member to form an ink image on the intermediate imaging member.

4. The process of claim 3, further comprising:

disengaging the wiper blade from the rotating intermediate imaging member after the release agent applicator disengages from the rotating intermediate imaging member.

5. The process of claim 1 further comprising:

monitoring accumulated time of engagement between the release agent applicator and the rotating intermediate imaging member; and extending a dwell time for engagement of the release agent applicator and the intermediate imaging member as the accumulated time increases.

6. The process of claim 1 further comprising:

de-coupling movement of the release agent applicator from movement of the wiper blade.

7. The process of claim 6 wherein the decoupled movement includes:

moving the release agent applicator into and out of engagement with the intermediate imaging member in accordance with rotation of a first cam; and moving the wiper blade into and out of engagement with the intermediate imaging member in accordance with rotation of a second cam.

8. An apparatus for applying release agent to an imaging member comprising:

an intermediate imaging member controller that slows rotation of the intermediate imaging member to a transfer speed as an ink image on the intermediate imaging member approaches a transferring roller nip;

a release agent coordinator for moving a release agent applicator into engagement with the rotating intermediate imaging member to apply release agent to the imaging member rotating at the transfer speed as the ink image is being transferred to media at the transferring roller nip; and a wiper coordinator for subsequently engaging the intermediate imaging member with a wiper blade to enable the wiper blade to meter a release agent bar formed by the applied release agent as the ink image is being transferred to the media at the transferring roller nip.

9. The apparatus of claim 8 wherein the intermediate imaging member controller increases a speed of rotation of the intermediate imaging member from the transfer speed after the transfer roller moves out of engagement with the intermediate imaging member, but before the release agent coordinator moves the release agent applicator out of engagement with the rotating intermediate imaging member.

10. The apparatus of claim 9 wherein the release agent coordinator disengages the release agent applicator from the intermediate imaging member rotating at the increased speed as a printhead is ejecting ink onto the intermediate imaging member to form an ink image on the intermediate imaging member.

11. The apparatus of claim 10 wherein the wiper blade coordinator disengages the wiper blade from the rotating intermediate imaging member after the release agent applicator disengages from the rotating intermediate imaging member.

12. The apparatus of claim 8 further comprising:

a monitor for accumulating time of engagement between the release agent applicator and the rotating intermediate imaging member and for extending a dwell time for engagement of the release agent applicator and the intermediate imaging member as the accumulated time increases.

13. The apparatus of claim 8 further comprising:

a first cam for moving the release agent applicator into and out of engagement with the intermediate imaging member; and a second cam for moving the wiper blade into and out of engagement with the intermediate imaging member.

14. A transfer apparatus for use in a solid ink jet printer comprising:

an intermediate imaging member onto which an image may be generated;

a print head that ejects ink onto the intermediate imaging member to form an image on the intermediate imaging member as it rotates in a first direction;

a drum maintenance roller that engages the intermediate imaging member to apply release agent to the intermediate imaging member during transfer of an image on the intermediate imaging member to a sheet of recording media;

a release agent wiper blade that engages the intermediate imaging member while the drum maintenance roller applies release agent to the intermediate imaging member, the release agent wiper blade removing a portion of the release agent applied to the intermediate imaging member by the drum maintenance roller; and a controller configured to generate signals to move the drum maintenance roller and the release agent blade into engagement with the intermediate imaging member while transfer of the image to the sheet of media is occurring.

15. The apparatus of claim 14, further comprising:

a first cam that controls movement of the drum maintenance roller into and out of engagement with the intermediate imaging member; and a second cam that controls movement of the release agent wiper blade into and out of engagement with the intermediate imaging member.

16. The apparatus of claim 15 wherein the first cam disengages the drum maintenance roller from the rotating intermediate imaging member before the release agent wiper blade disengages from the rotating intermediate imaging member.

17. The apparatus of claim 15 wherein the second cam disengages the release agent wiper blade from the rotating intermediate imaging member after the drum maintenance roller disengages from the rotating intermediate imaging member.

18. The apparatus of claim 15 wherein the first cam rotates in a first direction and the second cam rotates in the first direction.

19. The apparatus of claim 18 wherein the rotation of the first cam is de-coupled from the rotation of the second cam.

20. The apparatus of claim 14 further comprising:

a monitor for accumulating time of engagement between the release agent applicator and the rotating intermediate imaging member and for extending a dwell time for engagement of the release agent applicator and the intermediate imaging member as the accumulated time increases.

* * * * *